US011753231B2

(12) United States Patent
Ronning et al.

(10) Patent No.: US 11,753,231 B2
(45) Date of Patent: Sep. 12, 2023

(54) MULTI-USE BOTTLE SHIPPING ASSEMBLY WITH RESILIENT ELEMENTS

(71) Applicant: Tekni-Plex, Inc., Wayne, PA (US)

(72) Inventors: James Ronning, Wenatchee, WA (US); Jeff Burroughs, Wenatchee, WA (US)

(73) Assignee: Tekni-Plex, Inc., Wayne, PA (US)

( * ) Notice: Subject to any disclaimer, the term of this patent is extended or adjusted under 35 U.S.C. 154(b) by 0 days.

(21) Appl. No.: 17/508,145

(22) Filed: Oct. 22, 2021

(65) Prior Publication Data

US 2022/0127057 A1 Apr. 28, 2022

Related U.S. Application Data

(60) Provisional application No. 63/105,081, filed on Oct. 23, 2020.

(51) Int. Cl.
*B65D 81/133* (2006.01)
*B65D 5/50* (2006.01)
(Continued)

(52) U.S. Cl.
CPC ..... *B65D 81/133* (2013.01); *B65D 5/503* (2013.01); *B65D 71/70* (2013.01); *B65D 85/305* (2013.01)

(58) Field of Classification Search
CPC ..... B65D 81/133; B65D 5/503; B65D 71/70; B65D 85/305; B65D 5/5059; B65D 5/509; B65D 81/113
(Continued)

(56) References Cited

U.S. PATENT DOCUMENTS 4,823,959 A * 4/1989 Bixler ..... A47G 23/0208 294/87.2
4,911,300 A * 3/1990 Colonna ..... B65D 71/50 206/427
(Continued)

OTHER PUBLICATIONS

Written Opinion of the International Preliminary Examining Authority in related international application No. PCT/US2021/056171 dated May 23, 2022.
(Continued)

*Primary Examiner* — J. Gregory Pickett
*Assistant Examiner* — Jenine Pagan
(74) *Attorney, Agent, or Firm* — Polsinelli, P.C.

(57) ABSTRACT

A packing tray (10) for packaging glass bottles (B), such as a glass wine bottle, the packing tray comprising:

a plastic foam or molded fiber sheet (12) comprising a top wall (14) and an array (20) of recessed cell pockets (22) extending from the top wall;

the top wall having a peripheral surface (18) surrounding the array of cell pockets and defining a top reference plane TRP;

each cell pocket (22) comprising an open ring-shaped recess (24) having an elongated longitudinal axis LA transverse to the TRP and configured to be substantially aligned with a longitudinal axis of a glass bottle disposed upright in the recess;

the ring-shaped recess (24) including an upper cell portion (26) of a first diameter (FD) larger than a body diameter (BD) of the glass bottle, and lower ring portion (28) having resilient elements (30) radially disposed and spaced apart about a circumference (C) of the ring-shaped recess (24) and that extend radially inwardly from the first diameter (FD) and configured to engage the body diameter (BD) of the glass bottle and bend
(Continued)

under lateral stress (LS) such that the resilient elements provide repeatable shock absorption;

the peripheral surface (18) of the packing tray being sized to engage inner walls (42) of an outer shipping carton (40) in which the packing tray and glass bottles in the array of cell pockets are disposed for shipping.

14 Claims, 17 Drawing Sheets

(51) Int. Cl.
*B65D 71/70* (2006.01)
*B65D 85/30* (2006.01)

(58) Field of Classification Search
USPC ..... 206/427, 563, 433, 564, 562, 565, 558; 229/406, 904

See application file for complete search history.

(56) References Cited

U.S. PATENT DOCUMENTS

| | | | | |
|---|---|---|---|---|
| 6,290,057 | B1 * | 9/2001 | Hurley | B65D 81/133 206/592 |
| 6,702,115 | B1 * | 3/2004 | Roper | B65D 5/5071 206/427 |
| 10,507,950 | B2 * | 12/2019 | Carrier | B65D 81/133 |
| 2002/0195371 | A1 * | 12/2002 | Brown | A47G 23/0641 206/564 |
| 2013/0313145 | A1 * | 11/2013 | Gilfert | B65D 81/113 53/472 |
| 2018/0037359 | A1 | 2/2018 | Gilligan et al. | |
| 2019/0315564 | A1 | 10/2019 | Chung et al. | |
| 2019/0375571 | A1 | 12/2019 | Schmick | |

OTHER PUBLICATIONS

International Search Report and Written Opinion in related international application No. PCT/US2021/056171 dated Feb. 3, 2022.
International Preliminary Report on Patentability in related international application No. PCT/US2021/056171 dated Nov. 25, 2022 with PCT response filed Jul. 20, 2022.

* cited by examiner

MULTI-USE BOTTLE SHIPPING ASSEMBLY WITH RESILIENT ELEMENTS

FIELD OF THE INVENTION

The present invention relates to a packing tray and assembly for shipping glass bottles, such as glass wine bottles.

BACKGROUND OF THE INVENTION

Generally, wine is commonly shipped to consumers in several configurations and different types of packaging. Packaging for wine, and other types of beverages in glass containers may generally consist of a corrugated container having top and bottom trays along with bottle supporting elements, where these bottle supporting elements are commonly made from expanded polystyrene or molded fiber. Depending on the design of the packaging, the beverage bottles may be arranged in the packaging with the bottles either upright, laid down, or any other feasible orientation. Having the bottles shipped upright gives two advantages over being shipped laying down. First, the bottles can be easily re-inspected before sealing the package to make sure the contents are correct. Second, the bottles are strongest structurally when placed in vertical compression down the central axis of the bottle, preventing the bottles from easily breaking in shipment.

Wine bottles and other beverages in fragile containers often come in a myriad of shapes and several common sizes. Generally, one of the two most common sizes of wine or beverage distributed to consumers are the standard 750 ml and the magnum 1500 ml bottle size. Glass wine bottles are quite strong in compression but fragile when loaded in lateral shear or subjected to a sudden shock load. Both expanded polystyrene and molded fiber packaging materials help to absorb shock loading during shipping.

The molded fiber process draws liquid paper pulp against a mold under vacuum, where it is dewatered and consolidated into a solid article, where the article is then dried into a finished product. When using molded fiber to form beverage container packaging or shipping container, in order to remove the molded pulp article in one piece it is necessary that the mold must be designed with a draft angle. Generally, the greater this draft angle deviates from vertical Y axis, the more room there is for the product to maneuver within and be released from the mold.

The draft angle in a stand-up molded fiber wine shipper creates several issues. When a wine bottle is inserted into the top article of a packaging or shipping container, it will contact the article at the bottle top and the top rim portion of the bottle neck. Where the bottle bottom is inserted into the bottom article of the shipping container, similarly, it will contact the bottle bottom and the bottom rim potion of the bottle body and be more prone to breakage. When the package or shipping container is subject to a sudden lateral shock, the bottle will be loaded at the contacting points of the container. This will in turn cause the mass of the bottle and its liquid contents to apply a shear force to the bottle at the bottle's weakest point, at the transition from the bottle neck to the bottle body, which may cause the failure of the bottle.

Adding a center divider to the package or container eliminates the shear force to an extent, as the center support creates a support element near the center of mass of the bottle. While different center dividers have been used in several configurations, the dividers possess differing levels of success and have a number of weaknesses. Dividers of corrugated material tend to work poorly due to the inability to provide a mid-bottle support structure. Dividers of molded fiber with a ring-shaped hole tend to provide superior lateral support because they provide an enclosure for the bottle body, absorbing a part of the shear force near the center of mass of the bottle.

Further, much of the existing prior art designs of shipping containers utilize deformable elements for energy absorption in their top and bottom contact surfaces of the top, center and bottom trays. The prior art for deformable elements (See, e.g., U.S. Pat. No. 5,335,770 to Baker, U.S. Pat. No. 5,816,409 to Baker, and U.S. Pat. No. 7,584,852 to O'Brien) use deformable elements as a primary feature in their packaging design, where the deformable elements are crushed under a load and used to cushion beverage bottles upon impact in shipping. Notably, when deformable elements formed from pulp and paper fibers absorb a load, the load causes a compression failure of a column of fibers, where the fibers are compressed and cannot recover their structural integrity. In other words, while the deformable elements absorb the shock effectively, the shape and design dimensions of the elements, together with the nature of the fibers only allow a one-time use of the deformable elements. Deformable elements are also less than ideal for shipping smaller diameter bottles, and are a very unwieldy design for the shipping and storage concerns of the center support.

What is desired, therefore, is a center support that may be used together with the top and/or bottom trays of a beverage container packaging assembly, where the center support design may provide a repeatable shock absorption, and would be able to accommodate a wider range of bottle diameters while retaining the maximum possible cushioning features to protect the bottles.

SUMMARY OF THE INVENTION

The present invention is for a bottle container shipping assembly, having resilient elements that can accommodate a wide range of bottle diameters, with reusable cushioning features to protect the bottles from breakage during the shipping process.

In one embodiment, a packing tray 10 for packaging glass bottles B, such as a glass wine bottle, the packing tray comprising:

- a plastic foam or molded fiber sheet 12 comprising a top wall 14 and an array 20 of recessed cell pockets 22 extending from the top wall;
- the top wall having a peripheral surface 18 surrounding the array of cell pockets and defining a top reference plane TRP;
- each cell pocket 22 comprising an open ring-shaped recess 24 having an elongated longitudinal axis LA transverse to the TRP and configured to be substantially aligned with a longitudinal axis of a glass bottle disposed upright in the recess;
- the ring-shaped recess 24 including an upper cell portion 26 of a first diameter FD larger than a body diameter BD of the glass bottle, and lower ring portion 28 having resilient elements 30 radially disposed and spaced apart about a circumference C of the ring-shaped recess 24 and that extend radially inwardly from the first diameter FD and configured to engage the body diameter BD of the glass bottle and bend under lateral stress LS such that the resilient elements provide repeatable shock absorption;

the peripheral surface 18 of the packing tray being sized to engage inner walls 42 of an outer shipping carton 40 in which the packing tray and glass bottles in the array of cell pockets are disposed for shipping.

In one embodiment, a packing assembly combined with one or more of:

- a bottom tray (50) having an array 51 of bottom tray recesses 52 aligned along the LA direction with the ring-shaped recesses 24 of the packing tray 10, each bottom tray recess 52 having an open top end 53 configured to receive a lower body portion LBP of the glass bottle and a closed bottom end 54 configured to engage a closed bottom end CBE of the glass bottle;
- a top tray 60 having an array 61 of top tray recesses 62 aligned along the LA direction with the ring-shaped recesses 24 of the packing tray 10, each top tray recess 62 having an open bottom end 63 configured to receive an upper neck portion UNP of the glass bottle and an upper portion 64 configured to engage and support the upper neck portion UNP of the glass bottle.

In one embodiment, the packing tray or packing assembly wherein the packing tray 10 and the bottom tray 50 have complementary peripheral support members 14F, 55F configured to support the packing tray above the bottom tray.

In one embodiment, the packing tray or packing assembly wherein the upper cell portion 26 of the packing tray 10 extends downwardly from the top wall 14 in the LA direction and includes one or more gaps 108G extending between adjacent recesses 24 of the packing tray.

In one embodiment, the packing tray or packing assembly, wherein the packing tray has one or more recessed support posts 118 that extend downwardly from the top wall 14 in the LA disposed between adjacent recesses 24 of the packing tray.

In one embodiment, the packing tray or packing assembly wherein the packing tray includes raised support posts 418 extending upwardly from the top wall 414 in the LA direction and disposed between adjacent recesses 424 of the packing tray.

In one embodiment, the packing tray or packing assembly wherein the raised support posts 418 of the packing tray engage the top tray 460.

In one embodiment, the packing tray or packing assembly wherein the top tray recesses 662 define a primary height PH of the top tray aligned in the LA direction, and the top tray has a plurality of top tray posts 618 disposed between the top tray recesses 662 that define a secondary height SH aligned in the LA direction that is less than the primary height PH, and the top tray recesses 662 and top tray posts 618 together define a ring-shaped cavity 619 to support the bottle neck BN of the glass bottle.

In one embodiment, the packing tray or packing assembly wherein assembled packing tray 10 and top tray 60 define a gap G aligned in the LA direction in which a central body portion CBP of the glass bottle extends.

In one embodiment, the packing tray or packing assembly of any prior claim, wherein the bottom tray 650 has divider walls 658 and posts 657 disposed between adjacent bottom tray recesses 652.

In one embodiment, the packing tray or packing assembly of any prior claim, wherein the closed bottom ends 654 of the bottom tray recesses 652 have deformable elements 680 to absorb vertical stress in the LA direction.

In one embodiment, the packing tray or packing assembly of any prior claim, wherein one or more of the aligned recesses 24, 52, 62 of the packing tray 10, bottom tray 50 and top tray 60 are configured to accommodate glass bottles of different body diameters.

BRIEF DESCRIPTION OF THE DRAWINGS

For a better understanding of the invention, and to show how the same may be carried into effect, reference will now be made, by way of example to the accompanying drawings, in which:

FIGS. 4A-4E are various views of the central packing tray of FIG. 1 assembled with a bottom tray and a top tray in accordance with one embodiment of the invention, showing two glass wine bottles of different diameters disposed in two adjacent open ended cell pockets of the central packing tray and aligned bottom tray recesses and top tray recesses, wherein FIG. 4A is a perspective view of the assembly, FIG. 4B is a front plan view, FIG. 4C is a cross-sectional view taken along the section lines 4C-4C of FIG. 4B, FIG. 4D is a side plan view, and FIG. 4E is an interior plan view of the top tray;

FIGS. 9A-9E are various views of the central packing tray of FIG. 8 assembled with a top tray and a bottom tray, and showing one wine bottle held by aligned recesses of the trays, wherein FIG. 9A is a front plan view, FIG. 9B is a side plan view, FIG. 9C is a cross-sectional view taken along section lines 9C-9C of FIG. 9A, FIG. 9D is a perspective view, and FIG. 9E is an interior plan view of the bottom tray (separate from the assembly);

DETAILED DESCRIPTION

Figure 1:
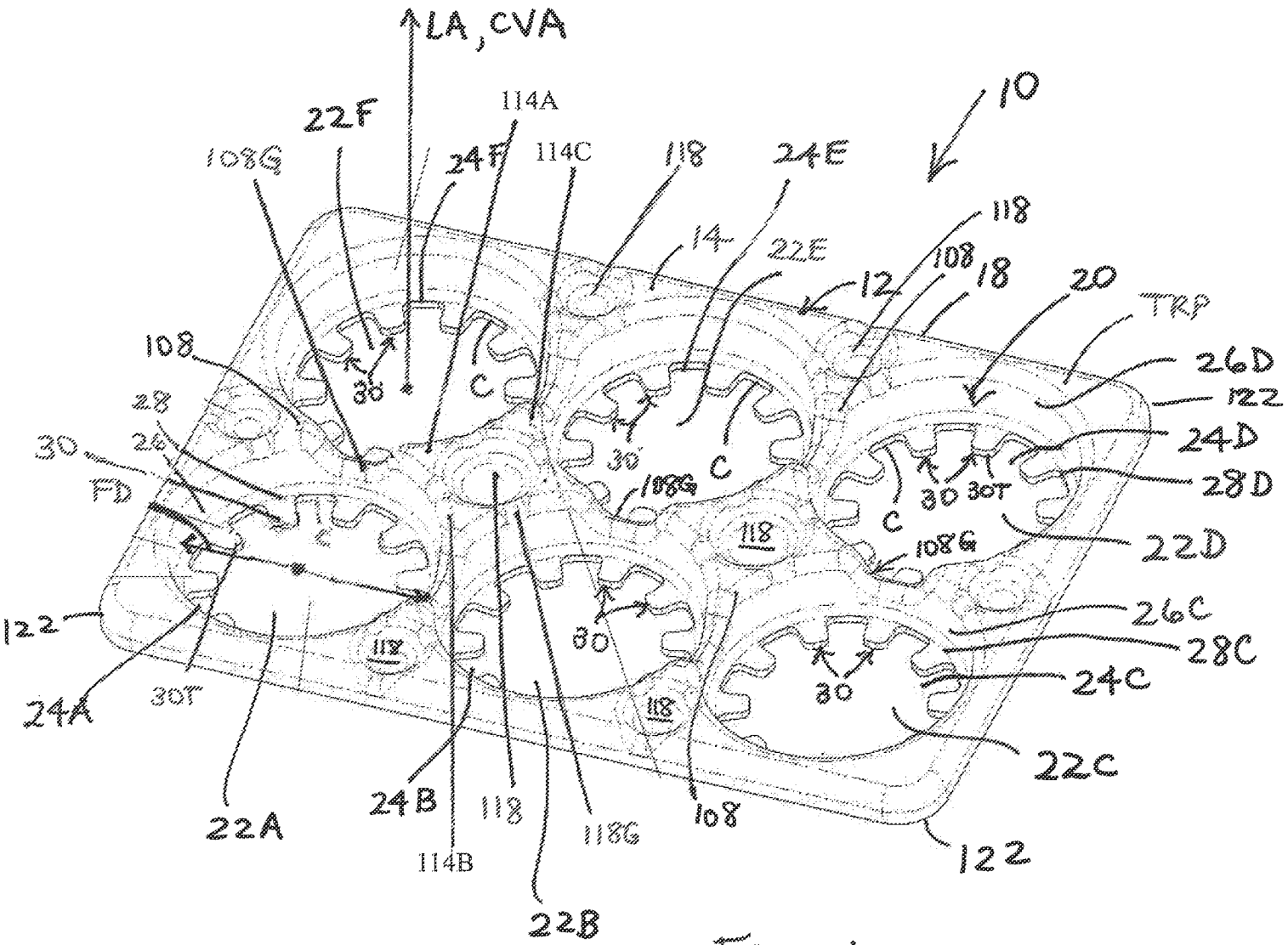
FIG. 1 is a perspective view of a 6-bottle central packing tray according to one embodiment of the invention.

FIGS. 1-4 illustrate a central packing tray 10 according to one embodiment of the invention, the central packing tray having an array of 6 open-ended cell pockets 22A-22F each having resilient elements 30 disposed about the inner circumference of the cell pocket for use in combination with a bottom tray 50 and/or a top tray 60 to form a packaging assembly. In other embodiments, the resilient elements 30 may be present as part of the top and/or bottom tray recesses 52, 62 as well.

Figure 2:
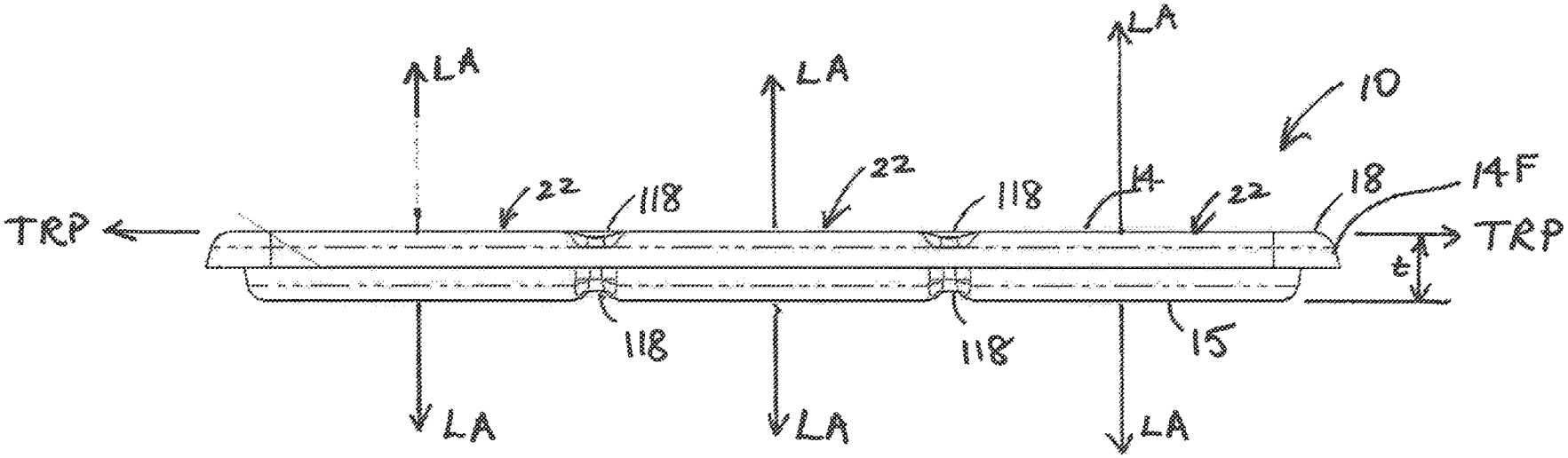
FIG. 2 is a side plan view of the central packing tray of FIG. 1.
Figure 3:
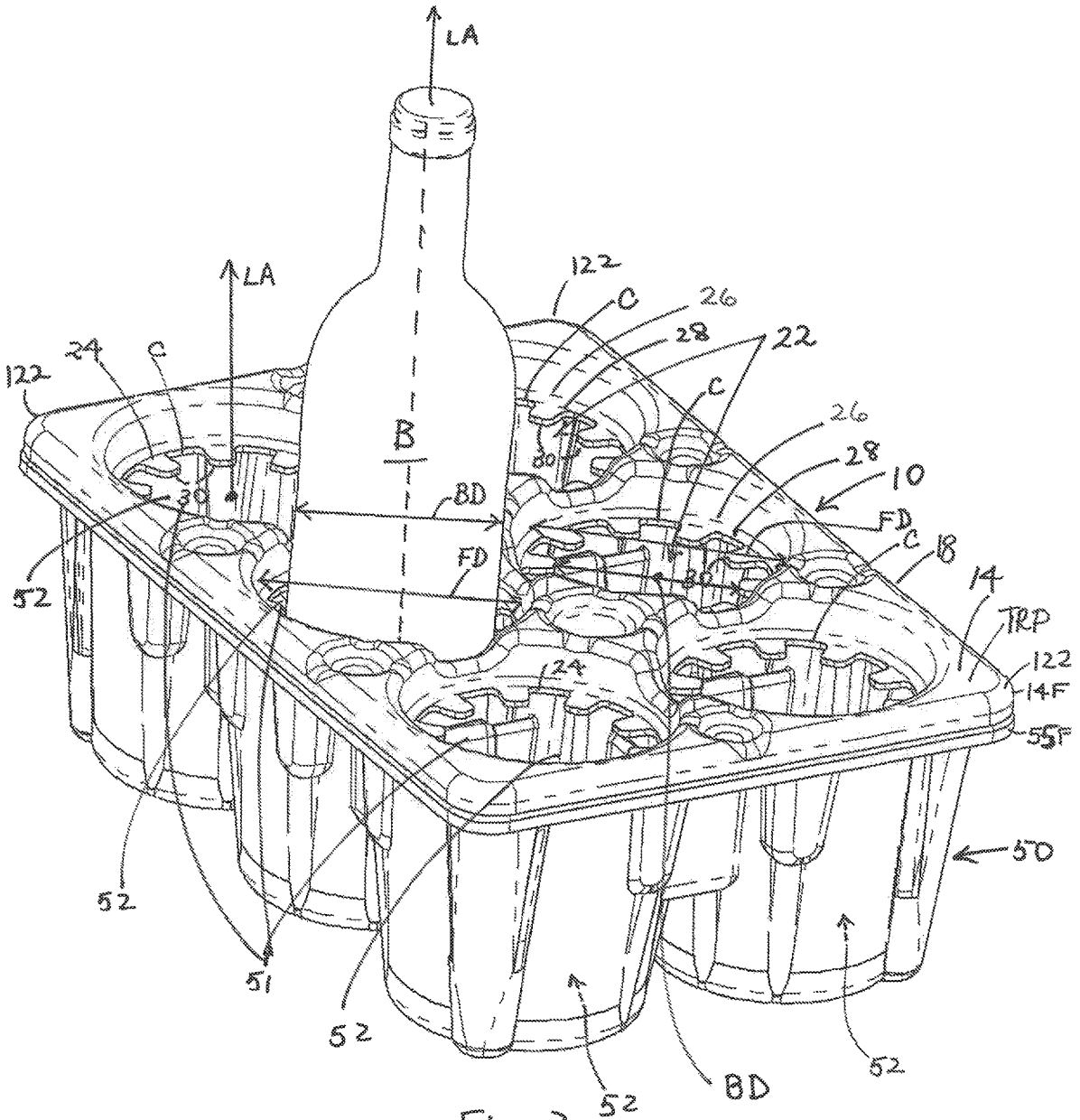
FIG. 3 is a perspective view of the central packing tray of FIG. 1 assembled with a bottom tray in accordance with one embodiment of the invention, and showing a glass wine bottle disposed in one of the six open-ended cell pockets of the central packing tray and aligned bottom tray recesses.

More specifically, FIG. 1 is a front perspective view of the 6-bottle central packing tray 10 according to one embodiment; FIG. 2 is a side plan view of the central packing tray 10; FIG. 3 is a perspective view of the central packing tray 10 assembled with a bottom tray 50 and showing a glass wine bottle B disposed in one of the six open-ended cell pockets 22 of the central packing tray and aligned bottom tray recess 52; and FIGS. 4A-4E are various views of the central packing tray 10 assembled with a bottom tray 50 and a top tray 60 showing two glass wine bottles B-1, B-2 of different diameters disposed in two adjacent open-ended cell pockets 22 of the central packing tray and the aligned bottom tray recesses 52 and aligned top tray recesses 62.

As shown in the embodiment of FIGS. 1-4, the packing tray 10 is configured for packaging glass wine bottles B, the packing tray comprising:

- a plastic foam or molded fiber sheet 12 comprising a top wall 14 and an array 20 of recessed cell pockets 22 extending from the top wall;
- the top wall having a peripheral surface 18 surrounding the array of cell pockets and defining a top reference plane TRP;
- each cell pocket 22 comprising an open ring-shaped recess 24 having an elongated longitudinal axis LA transverse to the TRP and configured to be substantially aligned with a longitudinal axis of a glass wine bottle disposed upright in the recess;
- the ring-shaped recess 24 including an upper cell portion 26 of a first diameter FD larger than a body diameter BD of the glass wine bottle, and lower ring portion 28 having resilient elements 30 radially disposed and spaced apart about an inner circumference C of the ring-shaped recess 24 and that extend radially inwardly from the first diameter FD and configured to engage the body diameter BD of the glass wine bottle and bend under lateral stress LS such that the resilient elements provide repeatable shock absorption;
- the peripheral surface 18 of the packing tray being sized to fit snugly within inner walls 42 of an outer shipping carton 40 in which the packing tray and glass wine bottles in the array of cell pockets are disposed for shipping.

As shown in FIGS. 3 and 4A-4E, the central packing tray 10 may be combined with one or more of:

- a bottom tray 50 having an array 51 of bottom tray recesses 52 aligned along the LA direction with the ring-shaped recesses 24 of the packing tray 10, each bottom tray recess 52 having an open top end 53 configured to receive a lower body portion LBP of the glass wine bottle and a closed bottom end 54 configured to engage a closed bottom end CBE of the glass wine bottle;
- a top tray 60 having an array 61 of top tray recesses 62 aligned along the LA direction with the ring-shaped recesses 24 of the packing tray 10, each top tray recess 62 having an open bottom end 63 configured to receive an upper neck portion UNP of the glass wine bottle and an upper portion 64 configured to engage and support the upper neck portion UNP of the glass wine bottle.

As shown in FIG. 2, the central packing tray 10 has a thickness tin the LA direction, extending between the top surface 14 and opposing bottom surface 15. The plurality of open-ended cell pockets 22 extend between the top and bottom surfaces, the cell pockets being open on both ends, and configured to receive a lower body potion LBP of the wine bottle B.

In the present embodiment, an upper wall portion 26 forms an upper part of the ring-shaped recess 24 and has a diameter FD that is larger than the body diameter BD of the lower body portion LBP, enabling easy insertion of the glass bottle into the top end (upper wall portion 26) of the recess. A lower wall forms the lower ring portion 28 having a smaller diameter (than the upper portion 26) and includes the resilient elements 30 configured to engage the lower body portion LBP. The resilient elements 30 are provided in the shape of a tab, here comprising the bottom wall 15 of the central packing tray. The tabs 30 are spaced apart about the inner circumference C of the lower ring portion 28, and extend radially inward. The tabs are configured to first bend and then resiliently compress under lateral forces (transverse to the LA direction), protecting the bottle from breakage under such forces. The elements 30 being resilient will bend under such force and then when the force is removed, they will effectively resume their original shape and dimensions. The bending tab thus absorbs energy if a lateral force is applied to the wine bottle held in the recess. The central packing tray 10 may also have rounded corners 122 along its top surface, to mate with complementary rounded corners of the and top and/or bottom trays. As shown in FIGS. 2-3, the top wall 14 of the central tray 10 may be wider than the bottom wall 15 of the central tray, and include an outward extending and downwardly curved flange 14F to hold the central tray in place on top of a complementary curved peripheral flange 55F on the bottom tray top wall 55.

The recesses 24 of the central packing tray, and mating recesses 52, 62 of the top and bottom trays, may be generally circular in shape and may have varying diameters, depending on the size of the wine bottles being shipped within. In some embodiments, the recesses may have different diameters across the surface of the tray. In some embodiments, neighboring recesses 22A, 22F may share a common wall 108 with each other, where the walls may have one or more gaps 108G within the common walls to accommodate varying dimensions of the top tray. The gap 108 of the wall may be any shape or dimension, so long as the gap does not eclipse the neighboring recesses 22A, 22F.

In some embodiments, there may be one or more recessed support posts 118 positioned between the recesses, e.g., between four adjacent recesses 22A, 22B, 22E, 22F. The posts 118 may also be disposed between two recesses and the peripheral edge 18 of the top surface 14. The post 118 extends down from the top surface 14 in the lateral direction LA toward the bottom surface 15, and is preferably closed on the bottom end 118BE to provide greater strength. The post 118 may have a plurality of curved edges 118A, 118B, extending between the common walls 108, each curved edge having a dimension of less than a quarter of the circumference of the recess 24. The curved edges of the support posts may also have gaps 118G along the curved edges. The support post 118 may also include a number of tapered or pointed ends 114A, 114B, 114C that serve as deformable elements and absorb lateral shock while the shipping assembly SA and bottles B are in transit.

Figure 15:
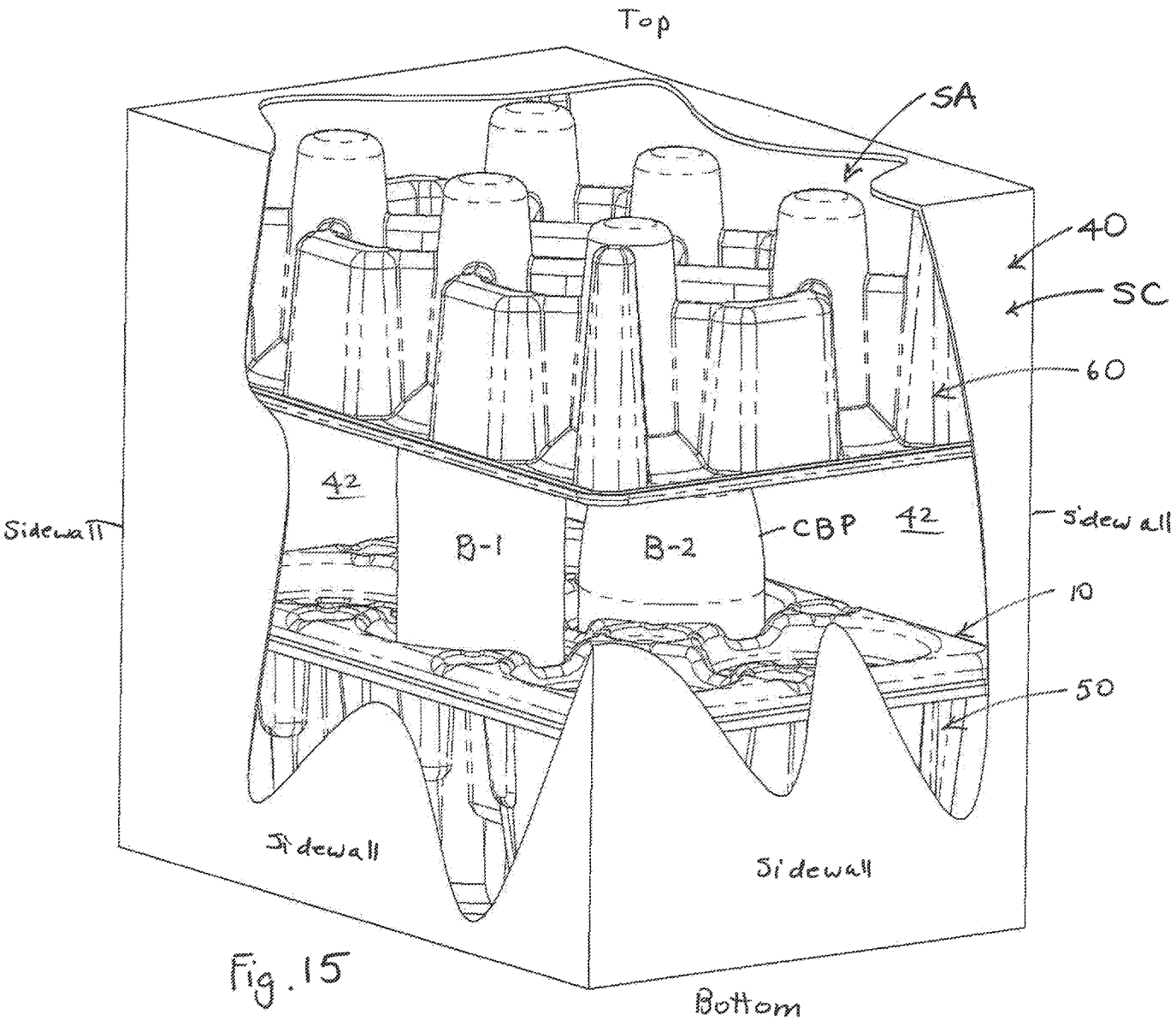
FIG. 15 is a front perspective, partial cut-away view of the 6-bottle assembly of top, central and bottom trays and two glass wine bottles of FIGS. 4A-4D disposed in an outer shipping carton.

Referring to FIGS. 3-4, the packing tray 10 may be assembled and used with one or both of a top tray 60 and a bottom tray 50, where the packing tray 10 lies on top of the bottom tray, and is not in contact with the top tray when all three are assembled together to form a shipping assembly SA (to be enclosed within an outer shipping container SC as shown in FIG. 15). FIG. 3 shows the central packing tray 10 disposed above and nestled within the bottom tray 50, with the lower surface 15 of the molded central packing tray sheet configured to fit within and engage a complementary upper surface 55 of the molded bottom tray sheet 50. More specifically, the bottom tray has an array 51 of six recesses 52 extending downwardly from a bottom tray top wall 55, each recess being open on the top end 53 and closed on the bottom end 54, and each bottom recess being aligned with the central vertical axis CVA of a corresponding packing tray recess 24, such that a closed bottom end CBE and a lower body portion LBP of a wine bottle is held securely within the surrounding walls of the central packing and bottom trays. The eight recessed support posts 118 of the central tray may also be aligned with and nestled within mating support recesses extending downwardly from the upper surface of the bottom tray, to hold the two trays in alignment and to collectively support the one or more wine bottles disposed in the cell pockets. The resilient elements 30 extending radially inwardly from each open ring-shaped recess 24 of the packing tray are thus enabled to engage the outer surface of the lower body portion LBP of the wine bottle, assisting in maintaining it in a vertically upright and aligned position, and also providing relief from lateral forces applied to the assembly of enclosed bottles, the resilient elements 30 bend and then resiliently deform with increasing application of lateral force so as to absorb and dissipate the energy of the applied lateral force, and prevent breakage of the glass wine bottle. When the force is removed, the resilient elements 30 then return to substantially their original position and dimensions and can provide the same function when another lateral force is applied at a future time (i.e., the resilient elements are re-usable, as opposed to one-time deformable elements that are not resilient and do not return to their original position and dimensions).

Figure 4A:
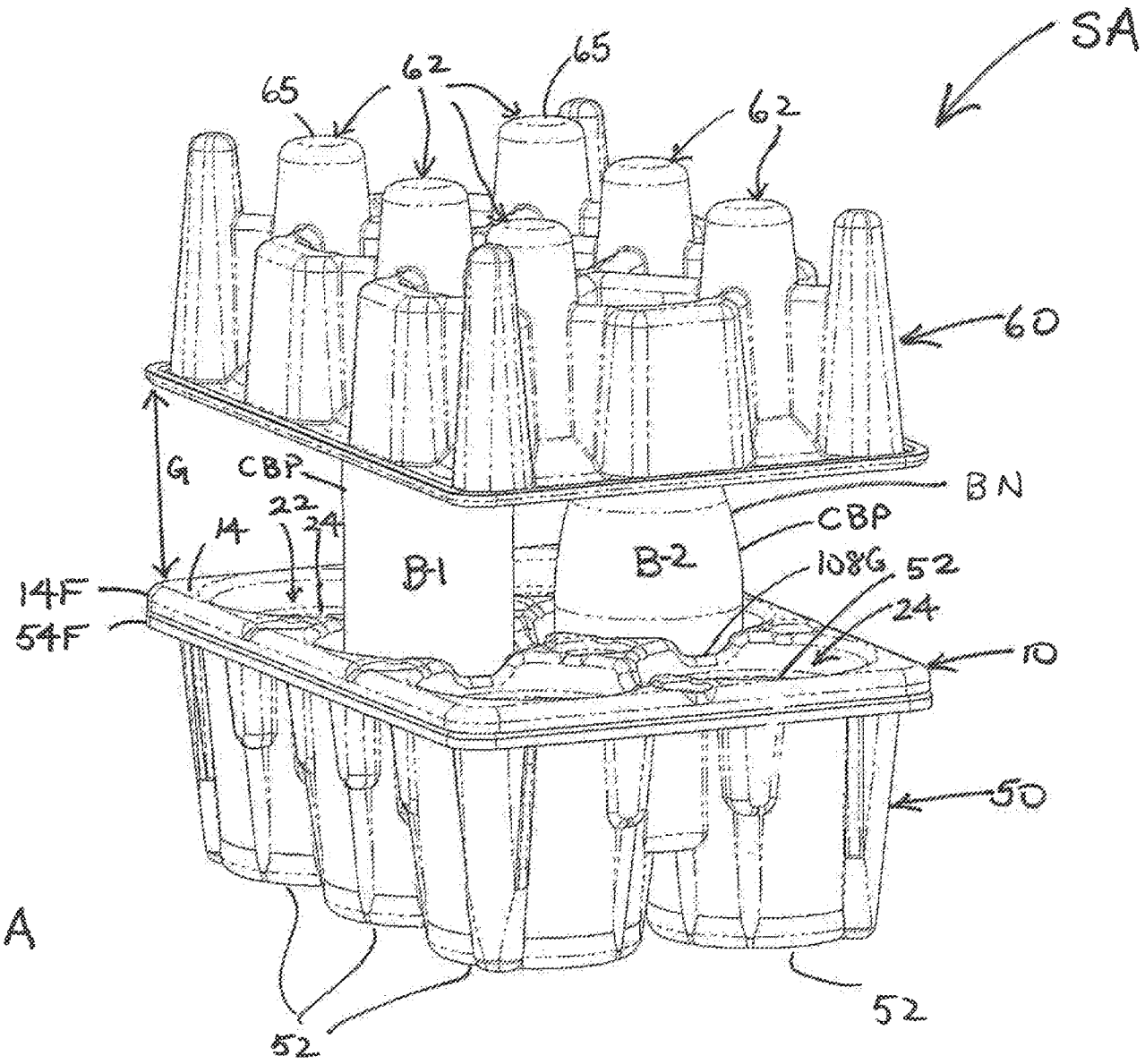
Figure 4E:
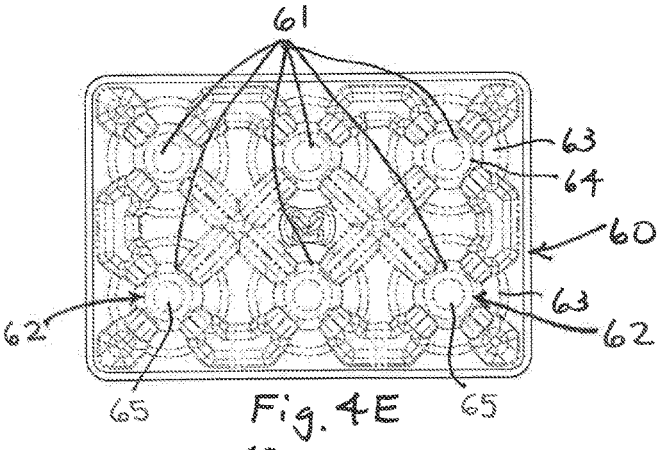
Figure 4B:
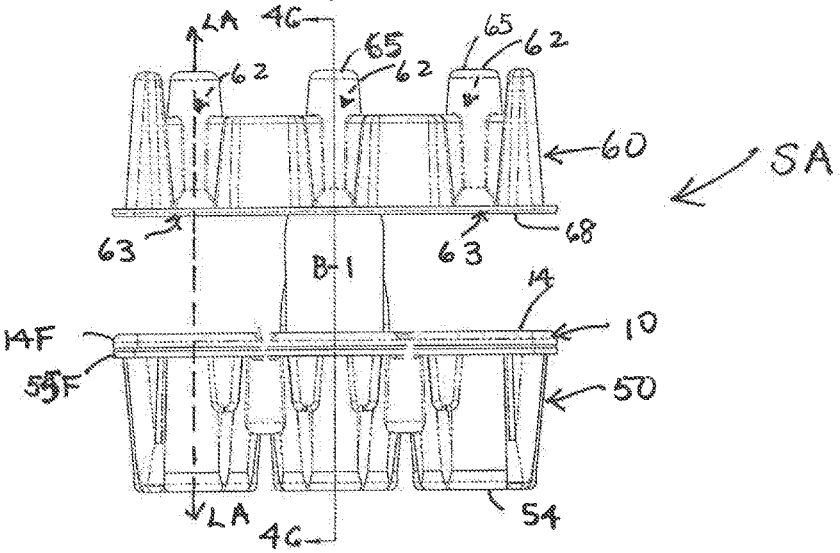
Figure 4D:
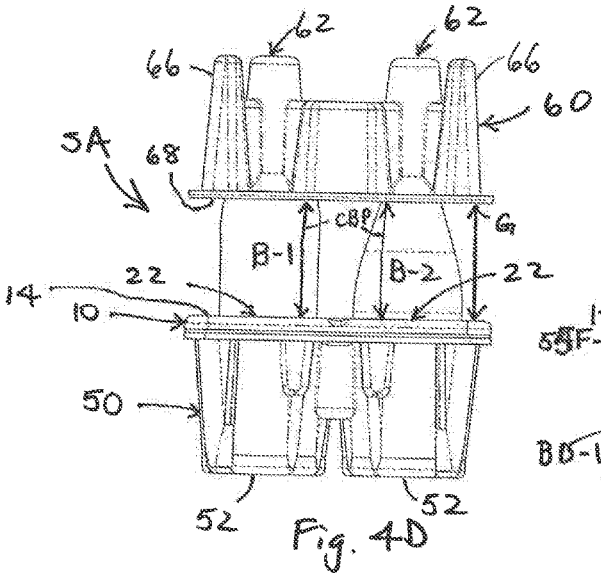
Figure 4C:
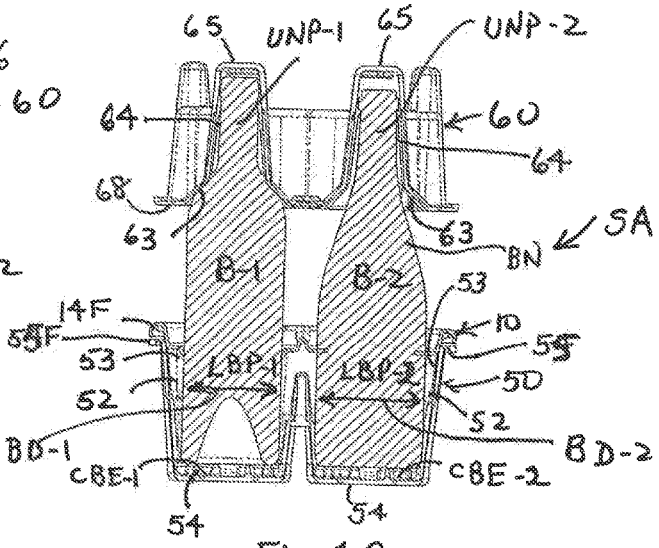

FIGS. 4A-4E show various views of the central packing tray assembled with the bottom tray 50 and top tray 60 showing two glass wine bottles B-1, B-2 of different outer body diameters BD-1, BD-2 disposed in two adjacent open ended cell pockets 22, 22 of the central packing tray and aligned bottom tray recesses 52 and top tray recesses 62. FIG. 4A is a perspective view of the assembly SA, FIG. 4B is a front plan view of the assembly SA, FIG. 4C is a cross-sectional view taken along the section lines 4C-4C of FIG. 4B, FIG. 4D is a side plan view of the assembly SA, and FIG. 4E is an interior plan view of the top tray 60. The cross-sectional views show the mating engagement of the central packing tray 10 and bottom tray 50, as well as the mating engagement of the central packing tray 10 and top tray 60. The top tray 60 provides six recesses 62 extending from a bottom top tray surface 67 upwardly in the LA direction, aligned with the recesses 22, 52 of the central and bottom trays, with the top tray recesses 62 being open on the bottom end 63 to receive an upper neck portion UNP of the wine bottle and potentially an upper shoulder or body portion of the wine bottle, and being closed on the top end 65, thus providing an enclosed area of protection for the upper end of the bottle. An upper portion 64 of the recess 62 is configured to engage and support the UNP. The top tray 60 also has reinforcing or support posts 66, disposed between or around the bottle recesses, to mechanically strengthen the top tray and resulting assembly SA of packing trays. In the assembled position, there is a gap G between the upper surface 14 of the central packing tray and the lower surface 68 of the top tray, that is spanned by a central body portion CBP (which may include a shoulder and lower neck portion) of the wine bottle. The entire assembly SA will be packed to fit snugly (slip fit) within an outer shipping carton SC having inner walls 42 (top, bottom, and 4 sidewalls, in a rectilinear configuration as shown in FIG. 15) that are configured to engage the outermost surfaces on six sides (top, bottom, and four side of the rectilinear shipping assembly (e.g., 65, 54, 14F, 55F, 67F).

Figure 5:
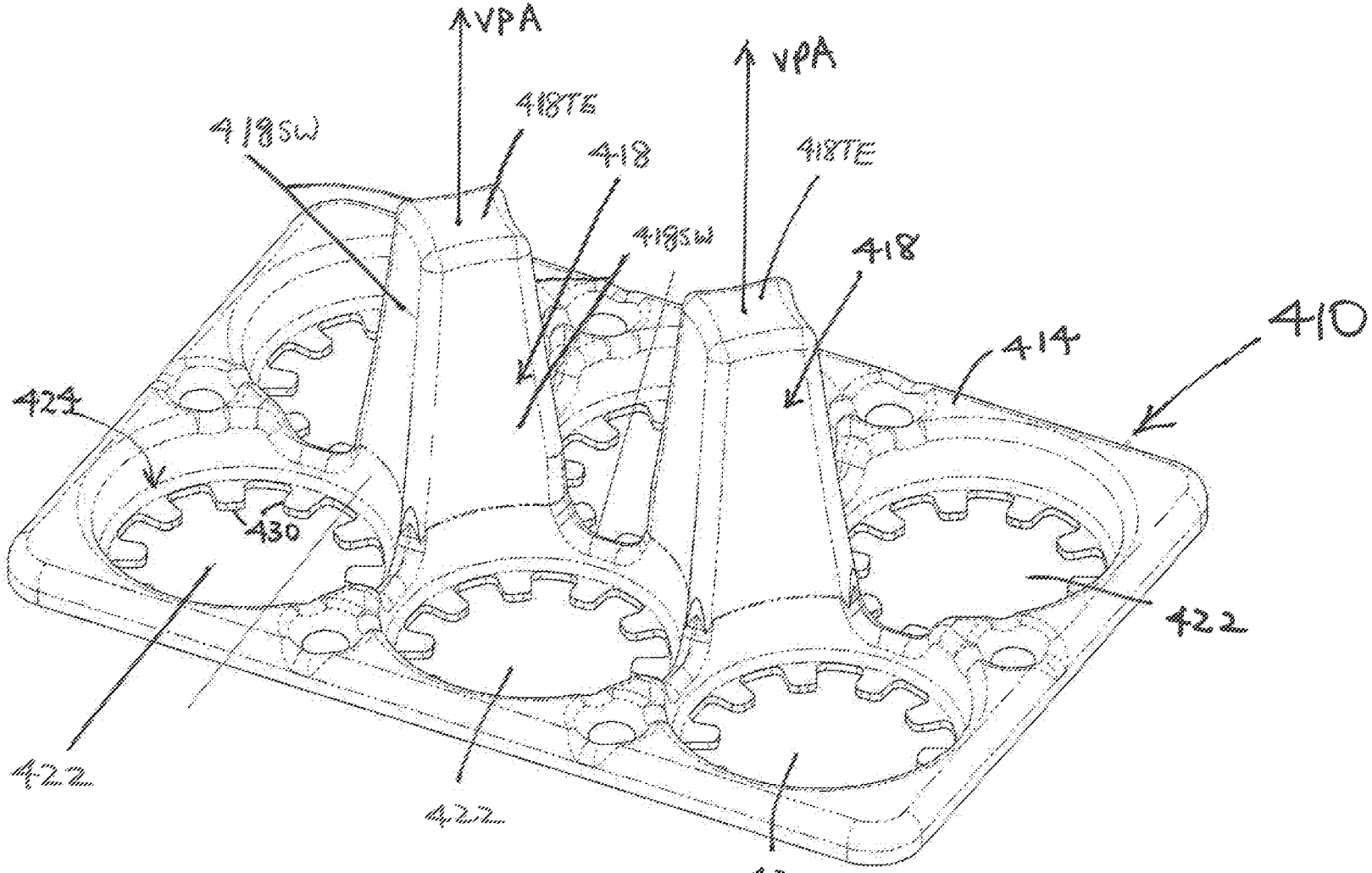
FIG. 5 is a perspective view of an alternative 6-bottle central packing tray in accordance with another embodiment of the invention, the tray including two raised support posts for engaging and supporting the top tray.
Figure 6B:
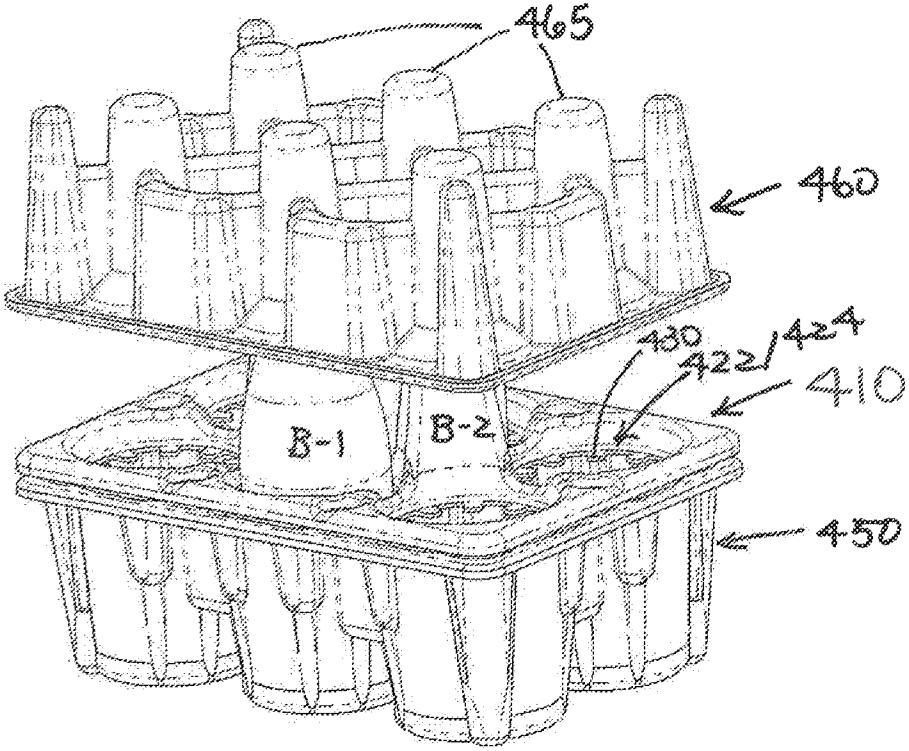
FIGS. 6A-6B are a cross-sectional front view and a perspective view of the central packing tray of FIG. 5 assembled with a bottom tray and a top tray in accordance with one embodiment of the invention, showing three wine bottles of different shapes or diameters in three of the six open-ended cell pockets of the central tray and aligned top and bottom tray recesses.
Figure 6A:
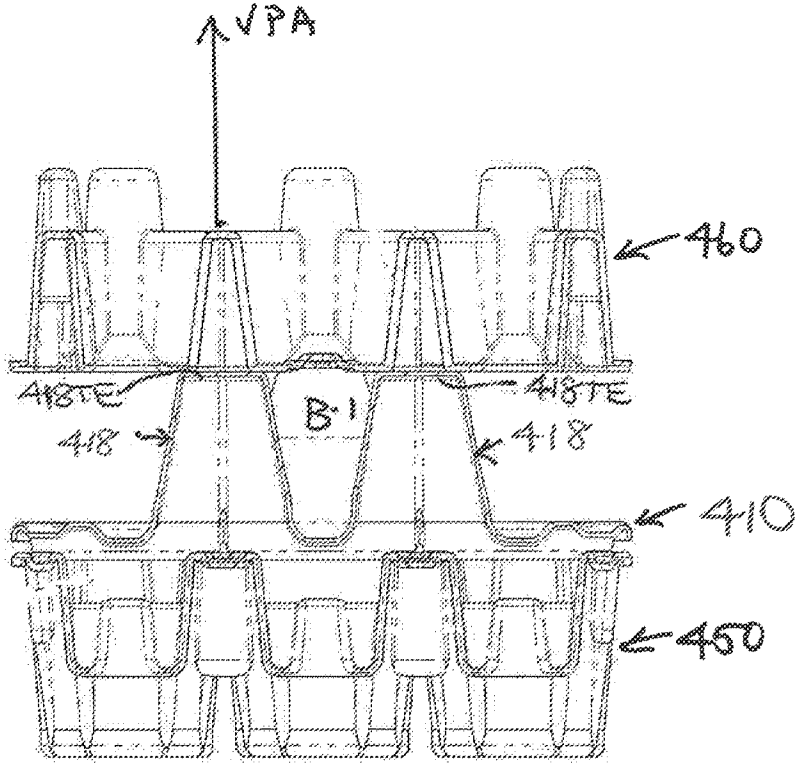

FIGS. 5-6, illustrate another example of a central packing tray 410 according to the invention having support posts or columns 418 that extend vertically upwardly from the top surface 414 of the central packing tray, and having a vertical post axis VPA that is aligned with LA (the elongated axis of each cell pocket recess 422/424). In this embodiment, the column 418 is formed from a series of curved side walls 418SW, where the curvature of the walls generally correspond to less than a quarter of the circumference of the recess 424. The column may taper upwards and become narrower at the closed top end 418TE of the column so that the column does not interfere when a top tray 460 is assembled together with the central packing tray 400 and pressing downwards. This embodiment of the central packing tray 400 may be used when the package integrity requires the central packing tray 400 to contact the top tray 460 as shown in FIG. 6 for extra support when shipping. The cell pockets/recesses 422/424 include resilient elements 430 as in the other embodiments. In the various embodiments, complementary elements have been given similar reference numbers in each 100 series of reference numbers.

As shown in the various embodiments disclosed herein, within the central packing tray 10, 410, 510, 610 each individual cell pocket recess may be generally circular and include a number of resilient elements 30, 430, 530, 630 distributed in a radial fashion along the inner circumference C of each cell pocket recess 22/24, 422/424, 522/524, 622/624. The resilient elements 30 each have a defined thickness (in the LA direction) and a tip end 30T extending inwards towards the center of the recess. The tip ends 30T may comprise a generally flat edge, or any other shape. In some embodiments, the resilient members 30 may be in different dimensions and shapes in addition to the tongue or tab shape shown in Figures, so long as the resilient members do not obstruct or prevent the bottle from being placed properly within the recess. The resilient elements 30 are designed to bend in service and the bottle cell pocket recess 22/24 can be sized to hold a much wider variety of bottle diameters.

The resilient element 30 is functionally superior to the deformable element in several ways. First, an element that is flexible and bending will deform with less stress per unit strain than an element in compression such as a deformable element. As such, a resilient element provides a softer stop or brake for the bottle when the bottle experiences lateral shock. More importantly, a resilient element will bend multiple times before failure, whereas a deformable element can only deform once for a given strain. As such, compared to a deformable element, a resilient member or element absorbs more energy prior to yielding. Finally, having the tips 30T of the resilient element in direct contact with bottles of different diameters serves to minimize the acceleration of the bottle from its neutral center position in the packaging, and lowers the lateral shock the bottle experiences or receives on impact.

Figure 7:
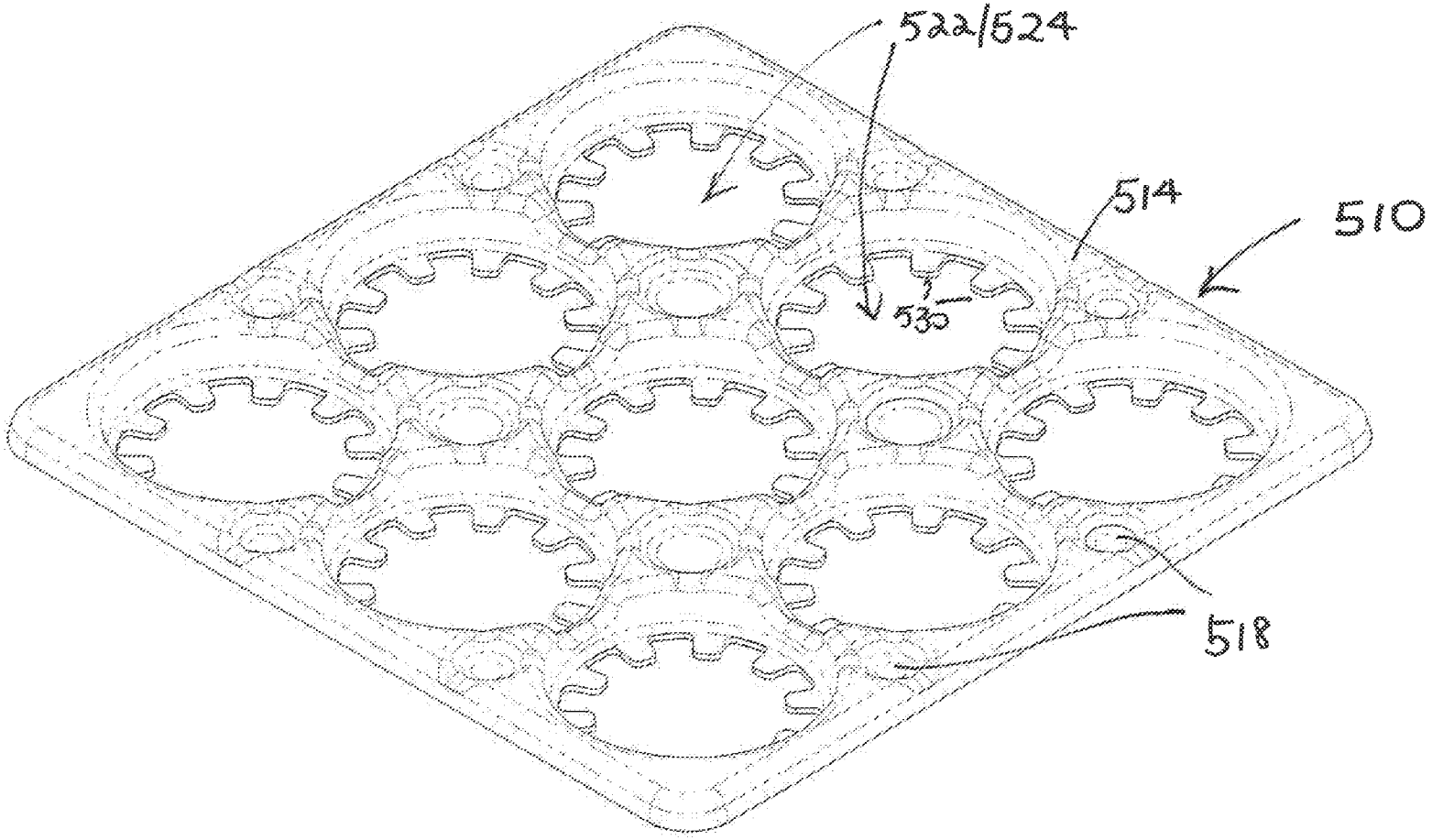
FIG. 7 is a perspective view of a 9-bottle central packing tray in accordance with one embodiment of the invention.
Figure 8:
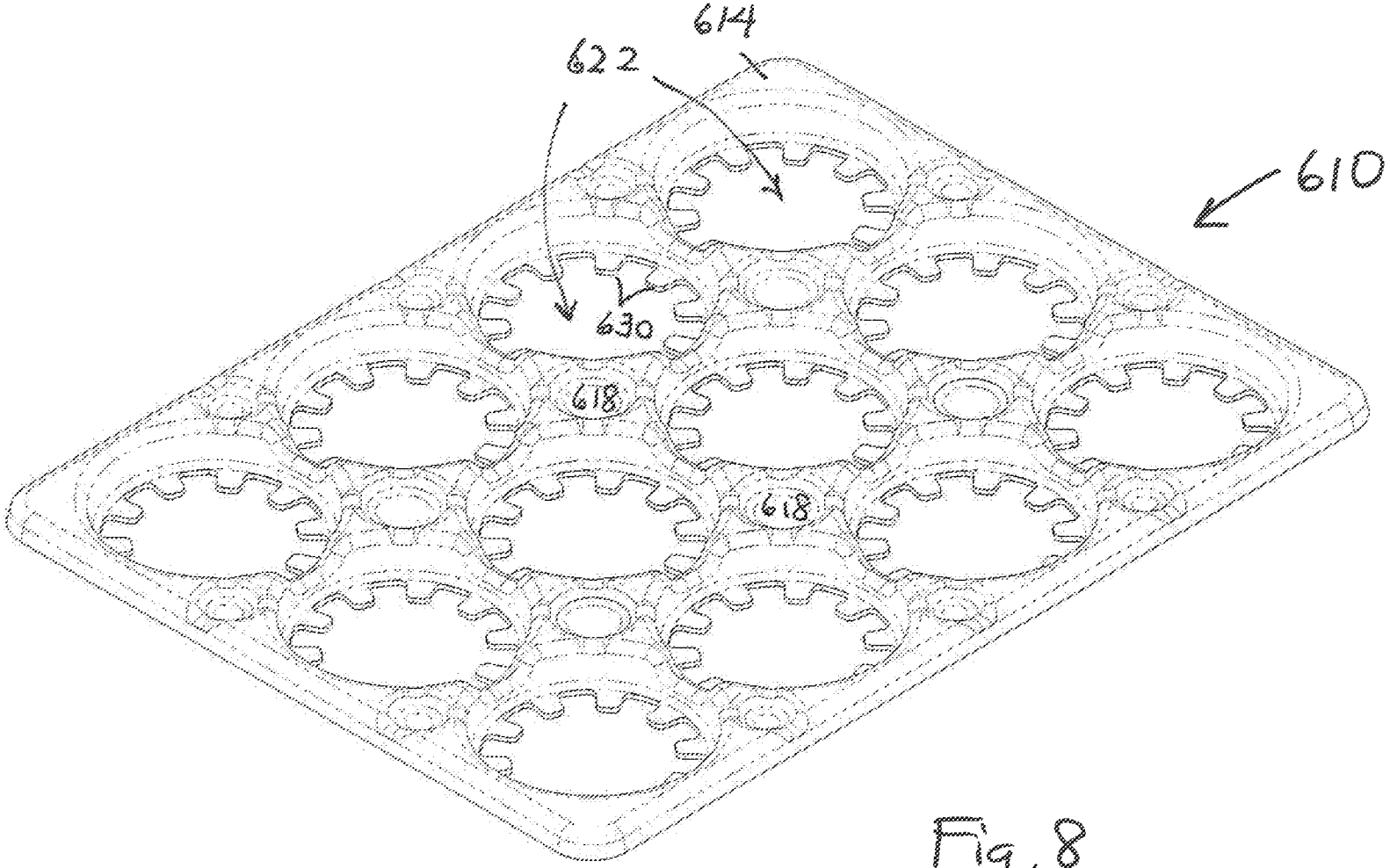
FIG. 8 is a perspective view of a 12-bottle central packing tray in accordance with one embodiment of the invention.
Figure 13:
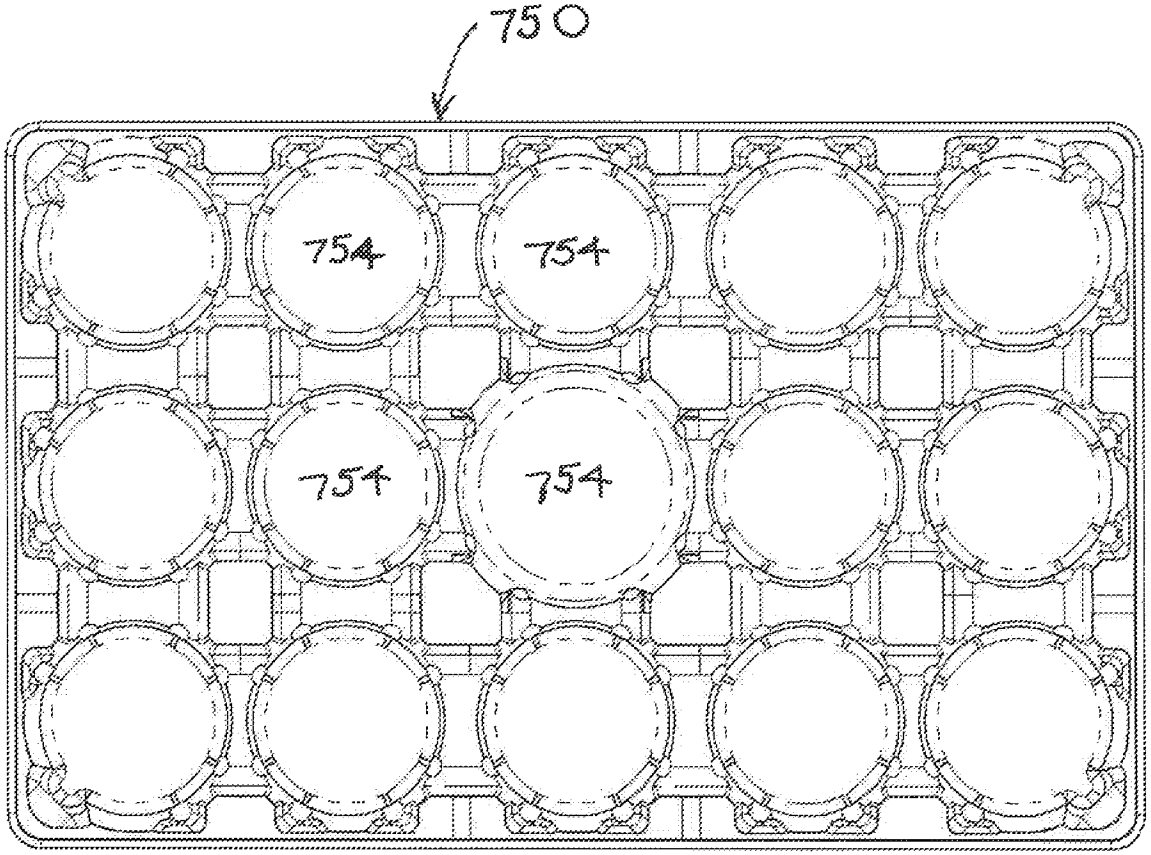
FIG. 13 is a plan view of a 15-bottle bottom tray with a single larger diameter recess (compared to the smaller diameters of the other recesses) in the center of the array of recesses, for holding a larger wine bottle (compared to the smaller diameter bottles to be disposed in the other smaller diameter recesses)
Figure 14:
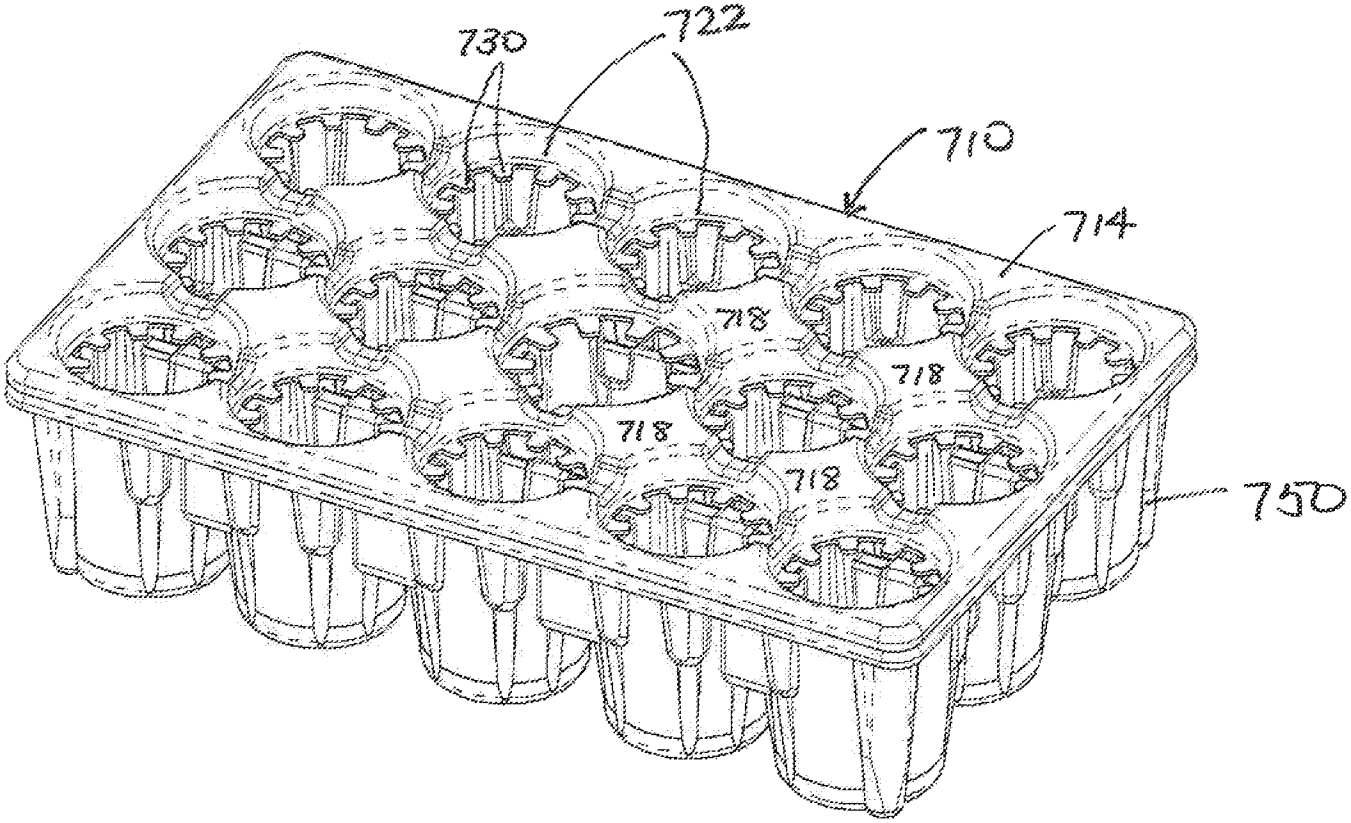
FIG. 14 is a top perspective view of a corresponding 15-bottle central packing tray assembled with the bottom tray of FIG. 13, and showing the larger diameter aligned recesses of the central packing and bottom trays.

In some embodiments, the central packing tray (and assembly) may be designed to hold either 6, 9, 12, 15, and 18 bottles in a stand-up (vertical) arrangement. FIG. 7 shows a central packing tray 510, similar to that of FIG. 1, but with a 3≥3 array of 9 cell pocket recesses 522/524 having resilient elements 530. FIG. 8 shows a central packing tray 610, similar to that of FIG. 1, but with a 3×4 array of 12 cell pocket recesses 622/624 having resilient elements 630. FIGS. 9-12 show a 3×4 array central packing tray 610 in combination with complementary top tray 660 and bottom tray 650. FIGS. 13-14 show two views of a 3×5 array central packing tray 710 and bottom tray assembly 750. All variations of the central packing tray 10, 410, 510, 610, 710 may be further utilized and compatible with a bottom tray 50, 450, 550, 650, 750 having deformable elements 680 such as in FIG. 12, e.g., inwardly projecting raise areas such as ribs formed on the inner wall of the closed bottom end 654 that engage the closed bottom end CBE of the glass bottle, so long as the central packing tray has a plurality of resilient elements 30, 430, 530, 630, 730 to accept portions of the bottle.

Figures 9A, 9B, 9C, 9D, 9E:
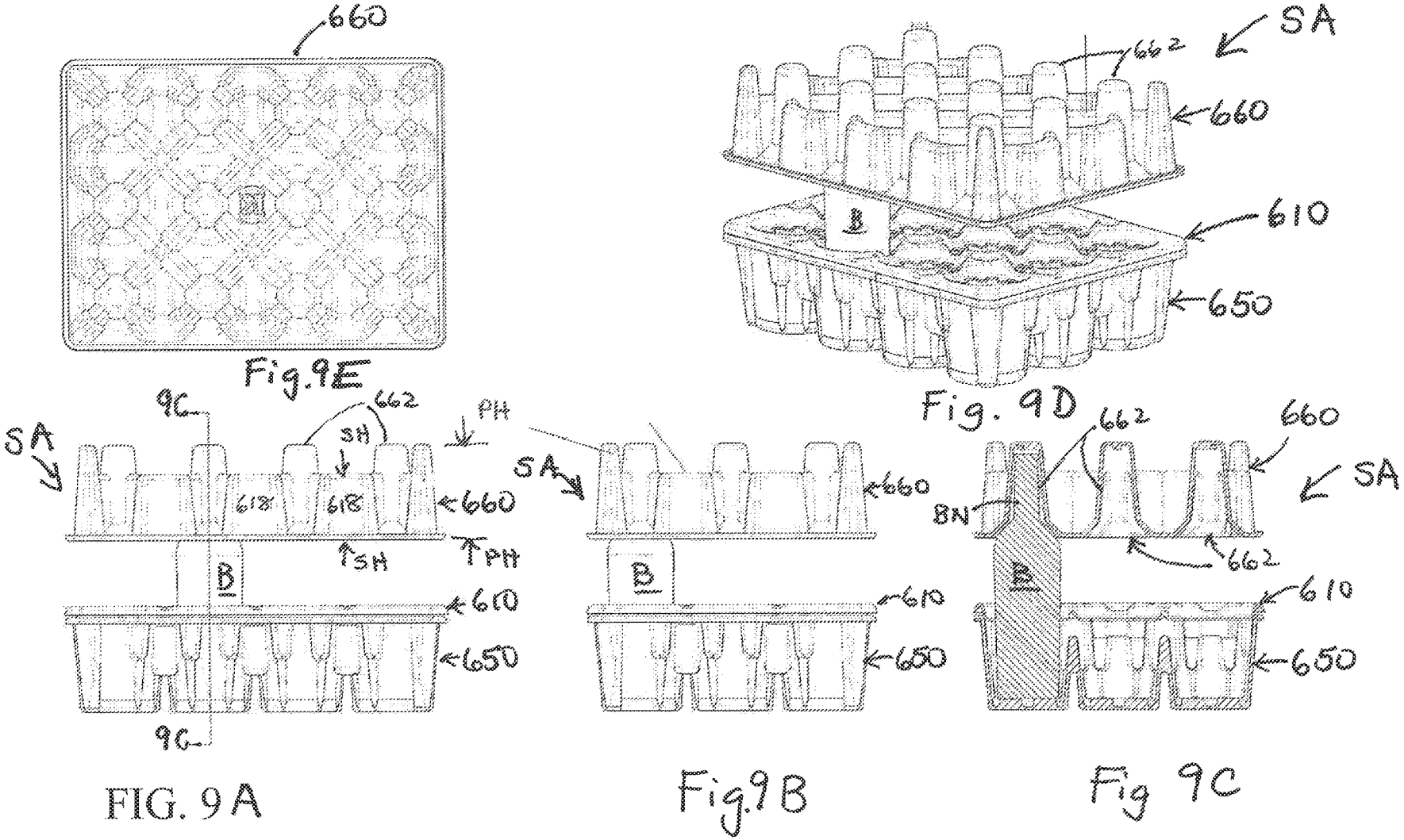
Figure 10A:
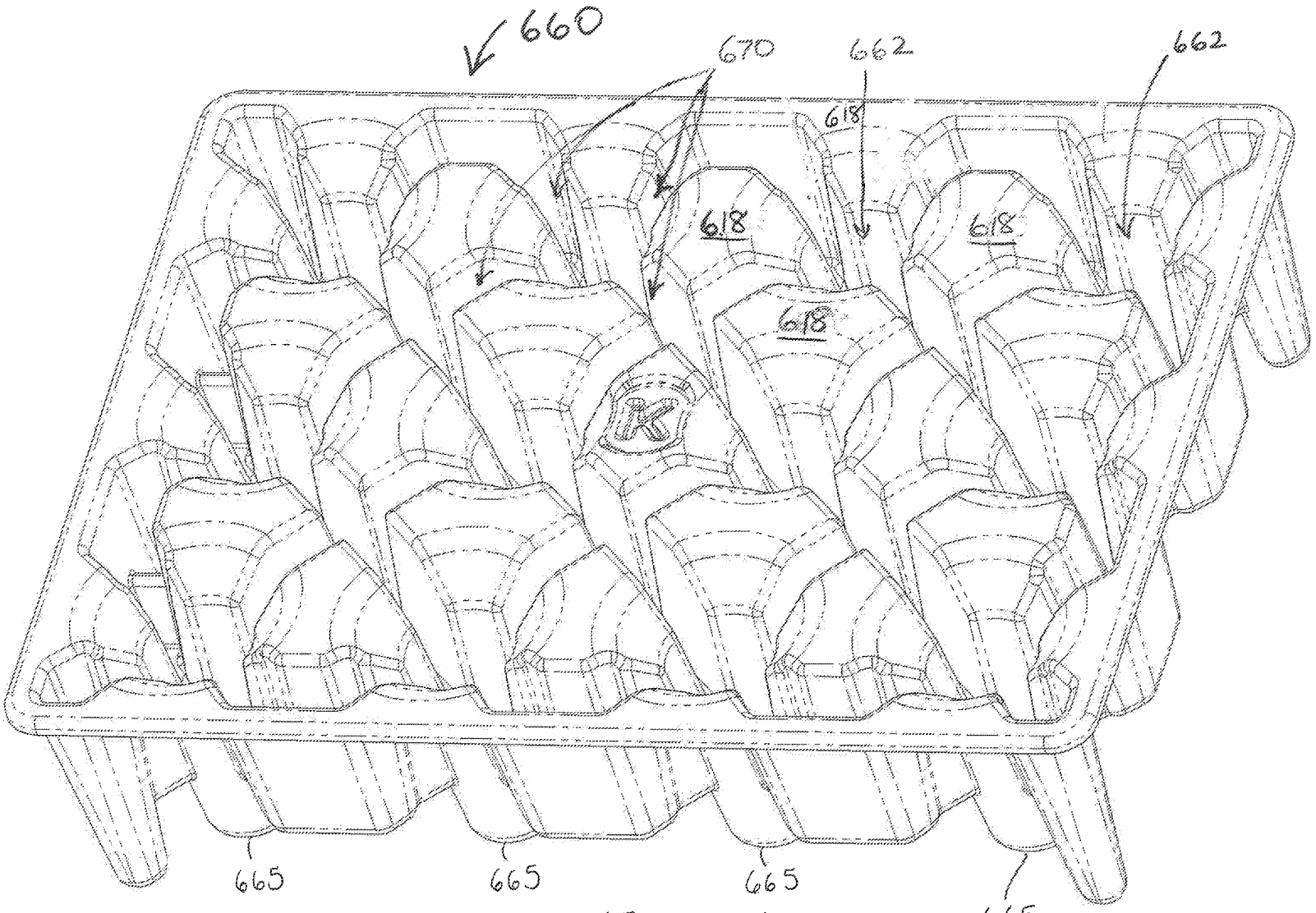
FIG. 10A is an exterior top perspective view.
Figure 10B:
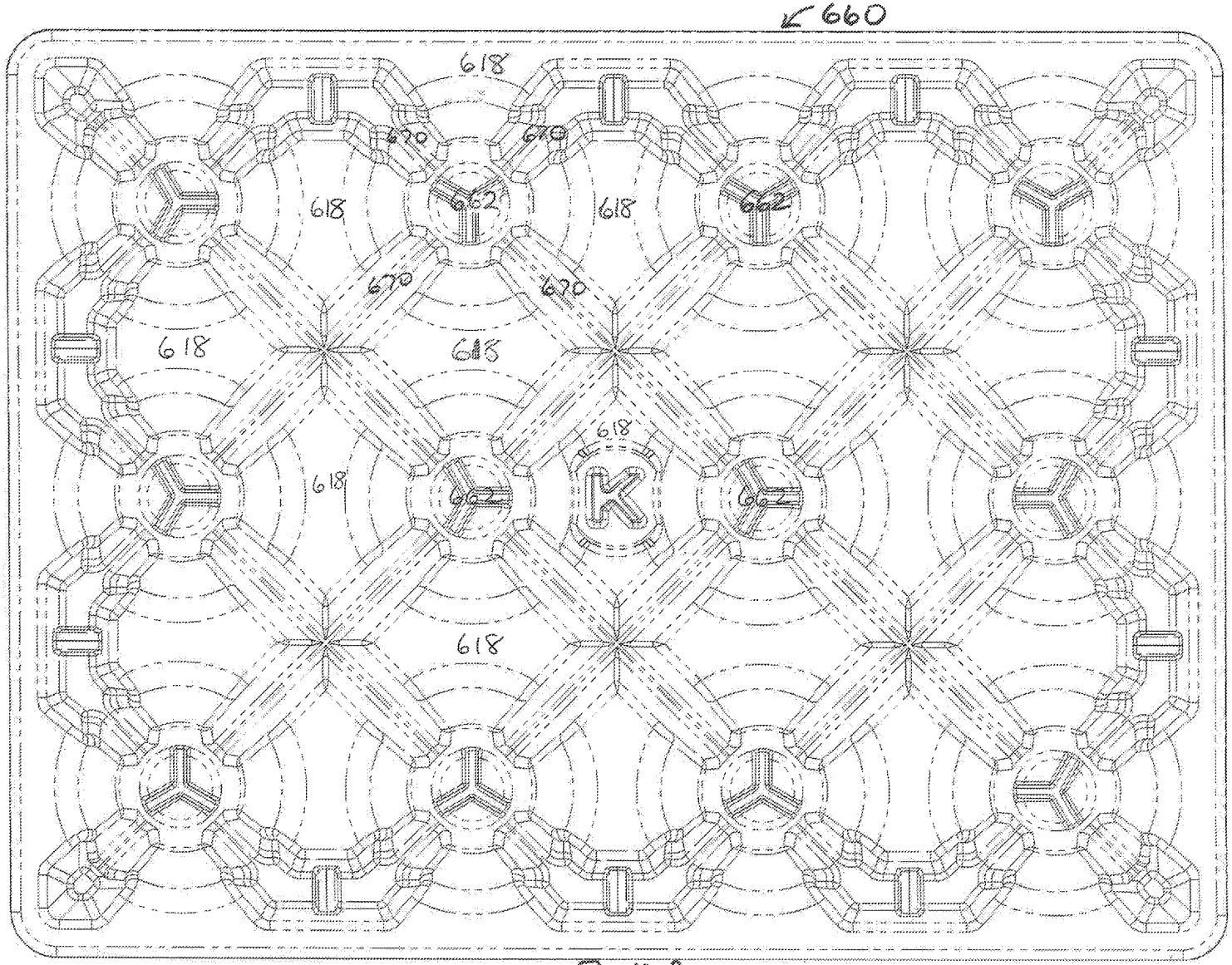
FIG. 10B is an exterior top plan view, of the top tray of FIG. 9.

FIGS. 9-10 illustrate another embodiment of a top tray 660, where the top tray has a primary height PH defined by the height of the recesses 662 to hold the bottle neck area of a beverage container. In a preferred embodiment, each recess 662 may be formed from and/or enclosed by a number vertical posts 618 aligned along the tray, where the edge of the post forming the recess may be curved, so as to resemble and grip a partial circumference of a bottle neck. Each post may have a closed top end 618TE with a generally flat surface. As shown in FIG. 9A, the top tray may also have a secondary height SH that is slightly shorter than the primary height PH, where the secondary and primary height may be connected by a vertical wall. Having the secondary height SH shorter than the primary height PH creates a complete circular cavity to support the bottle neck during use.

Each post 618 may have a tapered or grooved portion in the vicinity of the recess, where the grooved portion functions as a draft angle, to allow for additional space and ease of removal of the beverage containers. In some embodiments, the grooved portions of multiple posts together may resemble a tapered annular ring, where the ring tapers or slopes inwards towards the recess, with the recess at the center of the multiple grooved portions. Between each vertical post 618, there may be a series of canals or passageways 670 formed in the tray and aligned to form a geometric pattern, so as to isolate and individually disperse the load received by the tray in transit.

As shown in FIGS. 4, 6, and 9, in some embodiments where the central packing tray is assembled with top and bottom trays, there may be a substantial gap G between the top tray and the combined central tray and bottom tray, where the gap is formed from the beverage neck and a portion of the beverage bottle body. In other words, the bottle neck BN serves as a column contributing to the gap between the trays. With the main support to the assembled shipping assembly SA being from the bottle neck, the vertical posts 618 in the top tray function as support members to the columns formed by the bottle neck BN, and as such the vertical posts 618 as a whole are not designed to deform. In some embodiments, the top tray may also include deformable elements on the posts, and/or along some components on the tray. The top tray may be designed to hold either 6, 9, 12, 15, and 18 bottles or any number, so long as the design remains practical and functional.

Figure 11:
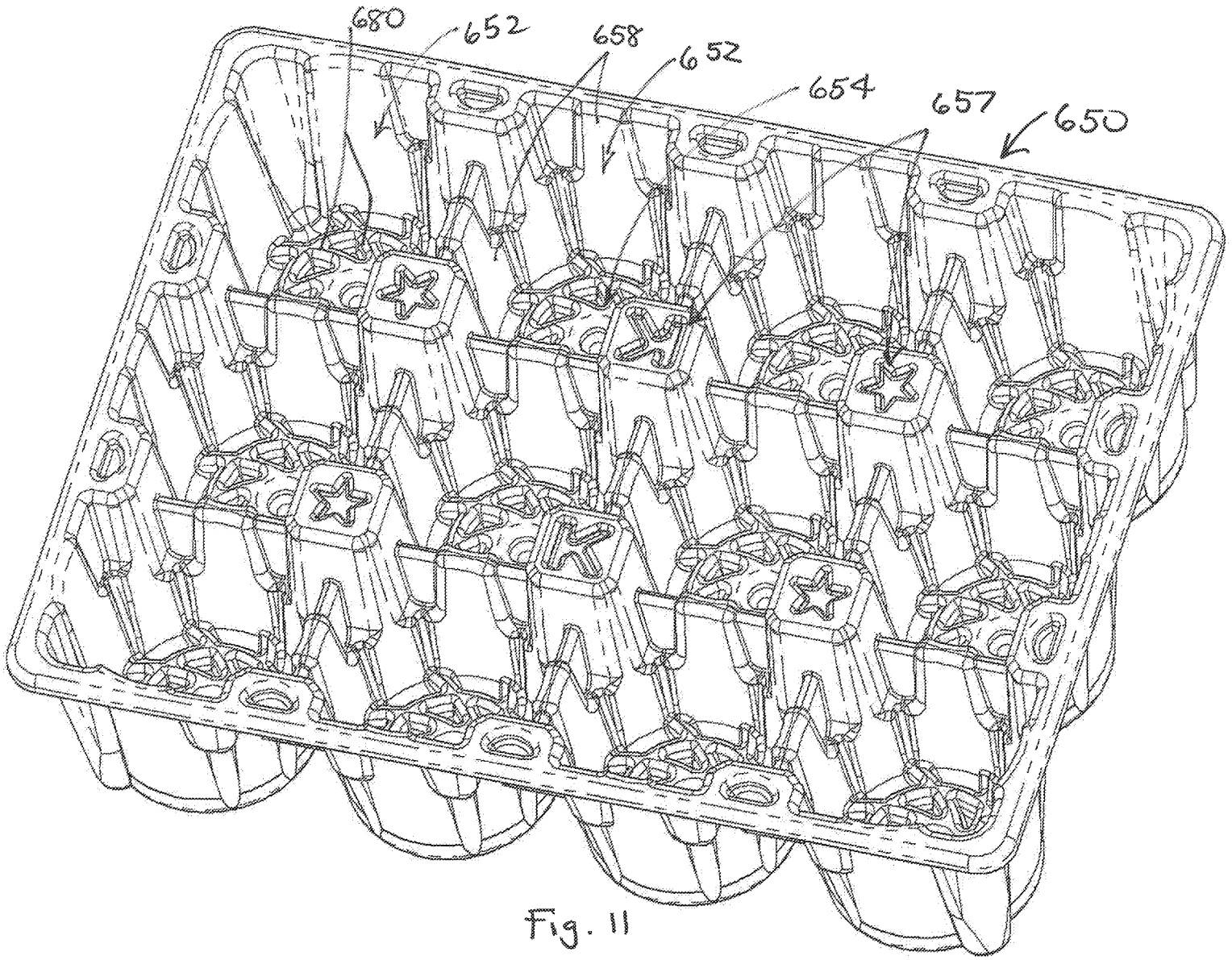
FIG. 11 is an interior top perspective view of the bottom tray of FIG. 9.
Figure 12:
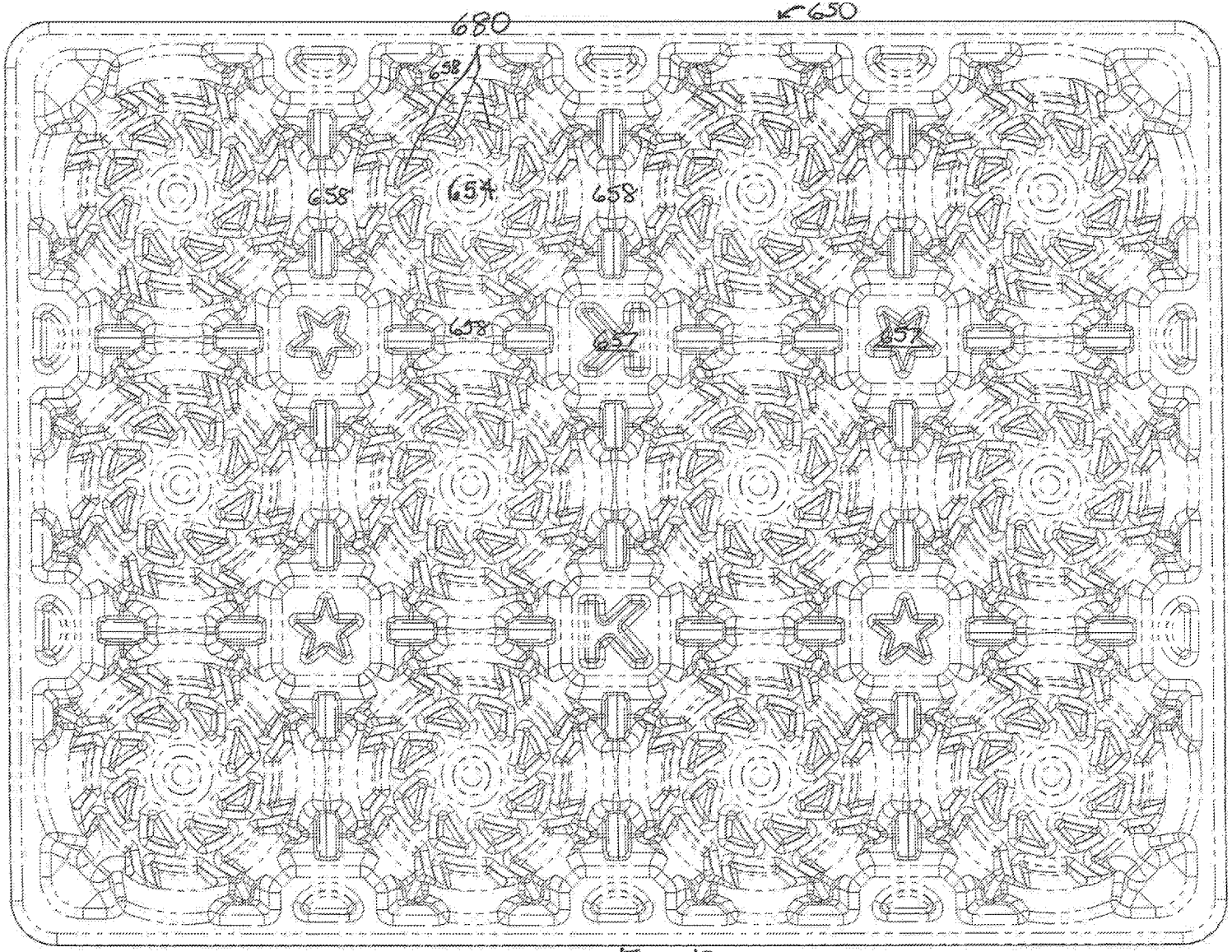
FIG. 12 is an interior top plan view of the bottom tray of FIG. 9.

FIGS. 11-12 illustrate an example of a bottom tray 650 where the bottom tray may include openings 652 with a bottom surface 654 to receive the body of the beverage container or bottle, where the openings 652 are formed by a series of walls 658 and pillars 657. The bottom tray may be designed to hold either 6, 9, 12, 15, and 18 bottles, or any other number so long as practical. In some embodiments, the pillars may have a top flat surface, where the body of the pillar is connected to the wall, and the wall has a lower height than the pillar. The wall 658 may have a raised portion to slightly grip onto the beverage container body. There may be imprints made on the surface of the pillar in varying shapes and designs for aesthetic purposes, or to serve as identification of the shipping container manufacturer.

In a preferred embodiment, there may be deformable elements 680 in the form of a rib or a protrusion from the bottom surface, where the deformable elements may be placed along the bottom surface of the opening, so that the deformable elements may provide energy absorption. When used to cushion beverage bottles, the deformable element is designed so that it may be permanently crushed under a load. Notably different from the resilient elements, the deformable elements cannot recover their structural integrity once crushed and are not reusable as a feature. The deformable elements may come in varying shapes and designs so long as practical and functional. Generally however, deformable elements are not suitable for shipping smaller diameter bottles and are unwieldy for center support designs.

Referring to FIGS. 13-14, the bottom tray and central packing tray as well as the top tray are configured to fit snugly within a corrugated outer container SC. In this example the trays have cell pocket recesses of different diameters, with a center most cell pocket of the 3×5 array of larger size to accommodate a larger bottle, such as a champagned bottle. In other words, the trays may be designed to accommodate both a magnum sized bottle and a standard size bottle shipped together in the same carton. The 15-bottle stand-up wine tray may have a central packing tray with a special adaptation of the resilient element feature. In some embodiments, the center holding chamber of the center tray and/or bottom tray may be designed to fit a larger diameter bottle or a standard bottle. Doing so allows the shipping of a large diameter champagne bottle or a magnum-sized wine bottle together with 14 standard bottles. This bonus bottle feature is highly desirable in the wine shipping industry and can significantly reduce the overall cost for separate shipping containers. Although the bonus bottle is located in the center of the trays in FIGS. 13-14, in some embodiments the location of the bonus bottle is flexible and may be anywhere along the surface of the tray, so long as aesthetic and functional concerns are met.

It will be appreciated that the invention is not restricted to the particular embodiment that has been described, and that variations may be made therein without departing from the scope of the invention as defined in the appending claims, as interpreted in accordance with principles of prevailing law, including the doctrine of equivalents or any other principle that enlarges the enforceable scope of a claim beyond its literal scope. In the various embodiments, complementary elements have been given similar reference numbers in each 100 series of reference numbers. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A packing tray (10) for packaging glass bottles (B), the packing tray comprising:

a plastic foam or molded fiber sheet (12) comprising a top wall (14) and an array (20) of recessed cell pockets (22) extending from the top wall (14);

the top wall (14) having a peripheral surface (18) surrounding the array of cell pockets and the top wall (14) defining a top reference plane (TRP) in a top surface of the sheet (12), and the sheet (12) having a bottom surface (15) opposing the top surface, wherein the packing tray (10) has a thickness (t) in a direction along an elongated longitudinal axis (LA) transverse to the top reference plane (TRP) and extending between the top surface and the opposing bottom surface (15), and wherein the recessed cell pockets (22) extend between the top and bottom surfaces and are open at opposite top and bottom ends of the recessed cell pockets (22);

each recessed cell pocket (22) comprising an open ring-shaped recess (24) including an upper wall portion (26) forming an upper part of the recess (24) and a lower wall forming a lower ring portion (28) of the recess (24), wherein the recess (24) is aligned with the elongated longitudinal axis (LA) transverse to the top reference plane (TRP) and is configured to be substantially aligned with a longitudinal axis of a glass bottle disposed upright in the recess (240), wherein the upper wall portion (26) extends downwardly in the direction of the elongated longitudinal axis (LA) transverse to the top reference plane (TRP) and the upper wall portion (26) has a first diameter (FD) which is configured to receive a glass bottle disposed upright in the recess;

wherein the lower ring portion (28) has an inner circumference (C) having a second diameter which is smaller than the first diameter, wherein the lower wall includes resilient elements (30) radially disposed and spaced apart about the inner circumference (C) of the lower ring portion (28), wherein the resilient elements extend radially inwardly from the inner circumference (C) of the lower ring portion (28) and are flexible and configured to engage the body diameter (BD) of the glass bottle and flexibly and resiliently bend under lateral stress (LS) such that the resilient elements provide repeatable shock absorption;

the peripheral surface (18) of the packing tray being sized to engage inner walls (42) of an outer shipping carton (40) in which the packing tray and glass bottles in the array of cell pockets are disposed for shipping.

2. A packing assembly comprising the packing tray of claim 1 combined with a bottom tray (50) and a top tray (60), wherein:

the bottom tray (50) having an array (51) of bottom tray recesses (52) aligned along the LA direction with the ring-shaped recesses (24) of the packing tray (10), each bottom tray recess (52) having an open top end (53) configured to receive a lower body portion (LBP) of the glass bottle and a closed bottom end (54) configured to engage a closed bottom end (CBE) of the glass bottle;

the top tray (60) having an array (61) of top tray recesses (62) aligned along the LA direction with the ring-shaped recesses (24) of the packing tray (10), each top tray recess (62) having an open bottom end (63) configured to receive an upper neck portion (UNP) of the glass bottle and an upper portion (64) configured to engage and support the upper neck portion (UNP) of the glass bottle.

3. The packing assembly of claim 2, wherein the packing tray (10) and the bottom tray (50) have complementary peripheral support members (14F, 55F) configured to support the packing tray above the bottom tray.

4. The packing assembly of claim 2, wherein the upper cell portion (26) of the packing tray (10) extends downwardly from the top wall (14) in the elongated longitudinal axis (LA) direction and includes one or more gaps (108G) extending between adjacent recesses (24) of the packing tray.

5. The packing assembly of claim 4, wherein the packing tray has one or more recessed support posts (118) that extend downwardly from the top wall (14) in the LA disposed between adjacent recesses (24) of the packing tray.

6. The packing assembly of claim 4, wherein the packing tray includes raised support posts (418) extending upwardly from the top wall (414) in the LA direction and disposed between adjacent recesses (424) of the packing tray.

7. The packing assembly of claim 6, wherein the raised support posts (418) of the packing tray engage the top tray (460).

8. The packing assembly of claim 2, wherein the top tray recesses (662) define a primary height (PH) of the top tray aligned in the LA direction, and the top tray has a plurality of top tray posts (618) disposed between the top tray recesses (662) that define a secondary height (SH) aligned in the LA direction that is less than the primary height (PH), and the top tray recesses (662) and top tray posts (618) together define a ring-shaped cavity (619) to support the bottle neck (BN) of the glass bottle.

9. The packing assembly of claim 2, wherein the assembled packing tray (10) and top tray (60) define a gap (G) aligned in the LA direction for receiving a central body portion (CBP) of the glass bottle extending through the gap.

10. The packing assembly of claim 2, wherein the bottom tray (650) has divider walls (658) and posts (657) disposed between adjacent bottom tray recesses (652).

11. The packing assembly of claim 2, wherein the closed bottom ends (654) of the bottom tray recesses (652) have deformable elements (680) to absorb vertical stress in the LA direction.

12. The packing assembly of claim 2, wherein one or more of the aligned recesses (24, 52, 62) of the packing tray (10), bottom tray (50) and top tray (60) are configured to accommodate glass bottles of different body diameters.

13. The packing tray (10) of claim 1, for packaging glass wine bottles.

14. The packing assembly of claim 2, for packaging glass wine bottles.

* * * * *